United States Patent [19]

Harpold

[11] 4,315,461

[45] Feb. 16, 1982

[54] SCREEN PRINTING MACHINE

[76] Inventor: C. W. Harpold, 274 Greenbrier Dr., SE., Grand Rapids, Mich. 49506

[21] Appl. No.: 80,450

[22] Filed: Oct. 1, 1979

[51] Int. Cl.[3] ..... B41F 15/04

[52] U.S. Cl. ..... 101/115; 101/126

[58] Field of Search ..... 101/114, 115, 126

[56] References Cited

U.S. PATENT DOCUMENTS

| | | | |
|---|---|---|---|
| 1,029,544 | 6/1912 | Horvath | 101/115 |
| 1,976,176 | 10/1934 | Lawrence | 101/126 |
| 2,034,003 | 3/1936 | Shurley | 101/115 |
| 2,458,773 | 1/1949 | Foard | 101/115 |
| 2,484,671 | 10/1949 | Bauman | 101/124 |
| 2,485,289 | 10/1949 | Jane | 101/115 |
| 2,613,595 | 10/1952 | Weldon | 101/115 |
| 2,909,116 | 10/1959 | Moore et al. | 101/126 |
| 3,101,665 | 8/1963 | Hall | 101/123 |
| 3,181,457 | 5/1965 | Eldred et al. | 101/124 |
| 3,244,096 | 4/1966 | Vasilantone | 101/126 |
| 3,427,964 | 2/1969 | Vasilantone | 101/115 |
| 3,543,679 | 12/1970 | Wahl | 101/126 X |
| 4,084,504 | 4/1978 | Fuchs | 101/115 |

FOREIGN PATENT DOCUMENTS

| | | | |
|---|---|---|---|
| 1460782 | 3/1969 | Fed. Rep. of Germany | 101/115 |
| 164044 | 6/1921 | United Kingdom | 101/126 |

OTHER PUBLICATIONS

Advertising, Price, and Installation Literature, Vastex International, Inc. of Somerville, New Jersey.

*Primary Examiner*—Edward M. Coven

*Attorney, Agent, or Firm*—Price, Heneveld, Huizenga & Cooper

[57] ABSTRACT

The specification discloses a screen printing machine comprising a platen connected with a frame, and a printing head rotatably mounted on the frame and having at least two printing screens pivotally connected therewith for pivoting the same between a printing position, and a raised storage position. The printing head is slideably and removably connected with the frame for selectively locating a pattern on the article to be printed, and/or bodily removing the printing head for replacement with an alternate printing head assembly having a different pattern therein, without disturbing the registry between the mating designs in the printing screens.

13 Claims, 9 Drawing Figures

SCREEN PRINTING MACHINE

BACKGROUND OF THE INVENTION

This invention relates to printing machines, and in particular to a multicolor screen printer for printing on fabrics, paper, and other similar materials.

Screen printing comprises fixing a piece of material to be printed upon a platen or other suitable surface, placing a silk screen on the material, and then transferring dye or ink through the screen onto the fabric by means of a roller or squeegee. When several colors are to be printed on the same piece of material, a separate screen is used for each color, and the colors are printed sequentially over one another, thereby requiring proper registry between the various screens to achieve a neat, clear, multicolored pattern which can be reproduced rapidly and reliably.

In custom printing shops, such as those specializing in the printing of indicia onto T-shirts, as well as other relatively low volume screen printing enterprises, the number of articles to be printed with a particular design at one time is typically very small. Hence, it is preferable that screen printers used in this specialized industry be highly adaptable, and capable of printing different styles and shapes of articles with a wide variety of colored patterns. Heretofore, such printing machines have been relatively large, complicated, and expensive, and are not easily adjustable to accomodate different printing requirements, particularly for low volume runs. For example, some such machines have rotating heads for rotating different screens into printing position above the printing platen. The thrust bearing assembly has to be an expensive, precision unit to insure that rotation will not lead to misalignment. One problem, even with expensive machinery, is that it is complicated or practically impossible to adjust or readjust the point on the platen at which printing takes place. The adjustment of one screen requires readjustment and reregistration of all the other screens.

SUMMARY OF THE INVENTION

The present invention provides a screen printer having a frame with a printing head mounted thereto in a manner which permits simple and accurate location of the pattern on the article to be printed. The printing head is adapted to detachably retain at least two printing screens with mating designs therein, and is rotatably connected with the frame to print clear, multicolored patterns on the article. The entire head can be slid along the frame and secured in various positions whereby the printing location on the platen can be adjusted without upsetting registry of the screens. The printing head is also removably connected with the frame, such that the entire printing head with one set of screens therein can be bodily removed from the frame and replaced with a different printing head and screen assembly to change the printing design without disturbing the registry between the various screens.

Another aspect of the present invention is to provide a screen printer with hinged clamps detachably connecting the screens with the printing head, and a registry stop which selectively engages the hinged clamps and positively positions the screens in a predetermined angular relationship with the platen.

Yet another aspect of the present invention is to provide a screen printer having the printing head rotatably mounted to the frame by a conventional thrust bearing, and providing at least three stops about the periphery of the bearing to abut the rotating plate portions thereof, thereby insuring concentric rotation of the printing head and screens, without the need for expensive, high precision thrust bearings.

Yet another aspect of the present invention is to provide a screen printer having a counterweight connected with each of the hinged screen clamps to normally maintain the screens in a raised, storage position, and wherein the counterweights are pivotally and eccentrically connected with the hinged screen clamps to vary the biasing force applied to the clamps to facilitate balancing variously sized printing screens.

Yet another aspect of the present invention is to provide a screen printer which is portable, easily set up, economical to manufacture, capable of printing clear and attractive multicolored patterns, efficient in use, capable of a long operating life, and particularly well adapted for the proposed use.

These and many other important advantages of the invention will be further understood and appreciated by those skilled in the art by reference to the following specification, claims, and appended drawings.

DETAILED DESCRIPTION OF THE PREFERRED EMBODIMENTS

Figure 1:
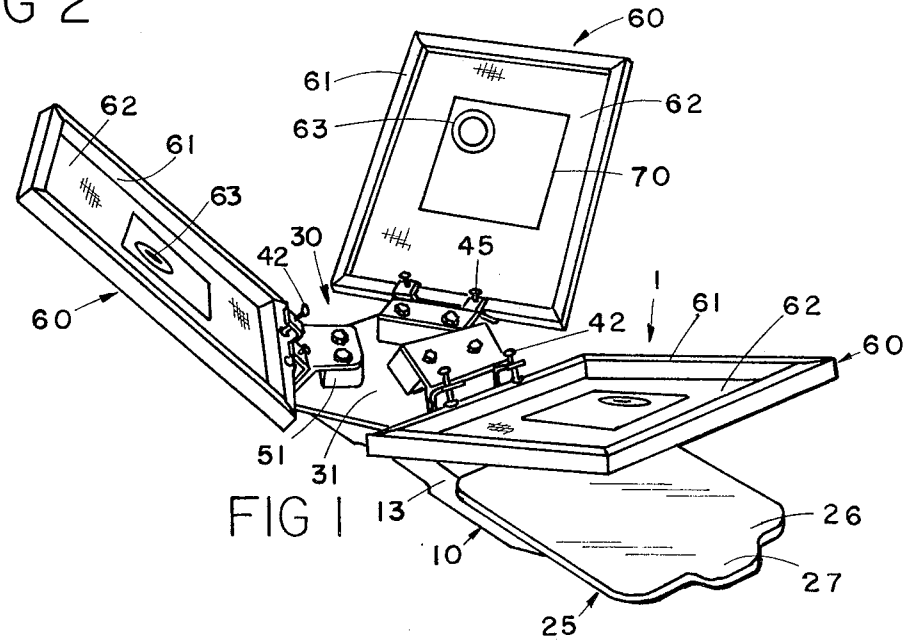
FIG. 1 is a perspective view of a screen printer embodying the present invention, adapted to receive three screens for three-color printing.

For the purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

Figure 2:
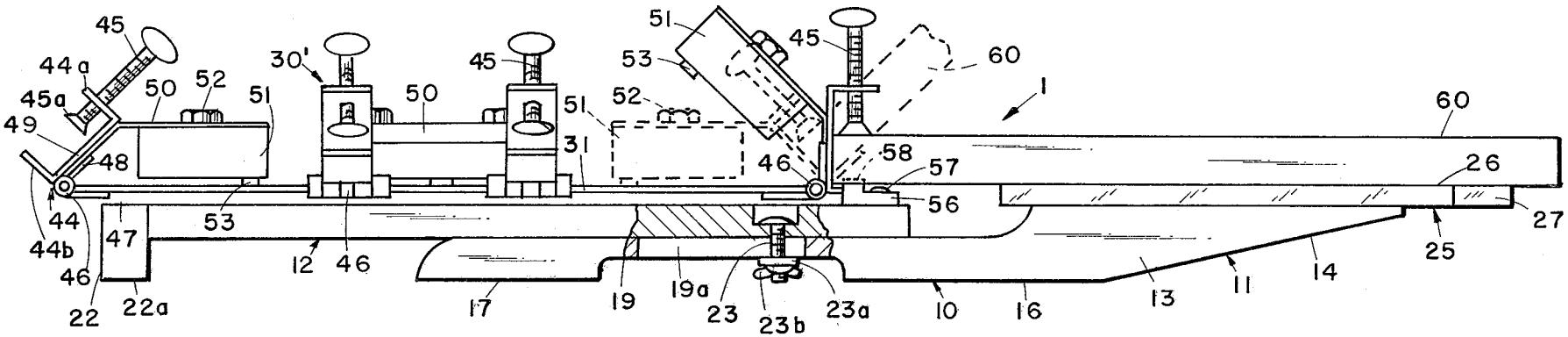
FIG. 2 is a side elevational view of a four-screen, four-color embodiment of the present invention, with a portion thereof broken away, and wherein the full lines illustrate a screen printing position, and the broken lines illustrate a raised, screen storage position.

The reference number 1 generally designates a screen printing machine embodying the present invention, comprising a frame 10, a printing platen 25 connected with frame 10 and adapted to receive thereon an article to be printed, and a printing head 30 having at least two printing screens 60 connected therewith and translating each of the printing screens between a printing position illustrated by the full lines of FIG. 2, and a storage position, illustrated by the broken lines of FIG. 2.

As best illustrated in FIG. 2, frame 10 comprises a forward section 11 having platen 25 connected therewith, and a rearward section 12 having printing head 30 attached thereto. The forward and rearward frame sections 11 and 12 are slidably connected for varying the distance between the printing head 30 and platen 25, so as to selectively locate the position of the pattern on the article without disturbing the registry between the designs on the various printing screens 60. In the illustrated structure, the forward frame section 11 comprises a pair of side rails 13 (FIG. 4) having an inclined forward portion 14 with the platen 25 connected to the upper surface thereof by a pair of fasteners 15. Each of the side rails 13 includes an intermediate foot 16 and an end foot 17 which are spaced apart longitudinally along the length of side rails 13, and are adapted to engage the supporting table or bench and support the screen printer thereon. A pair of cross braces 18 extend laterally between side rails 13 at the feet positions 16 and 17, and securely interconnect the side rails 13 to form a rigid frame structure. A medial portion 19 of each of the side rails 13 is disposed between feet 16 and 17 and is recessed or cut out toward the upper surface of the frame. Each of the medial portions 19 includes a vertically oriented, elongated slot **19*a* therethrough which is linear in shape, and extends substantially along the longitudinal center line of each of the side rails 13** for purposes to be described hereinafter.

Figure 4:
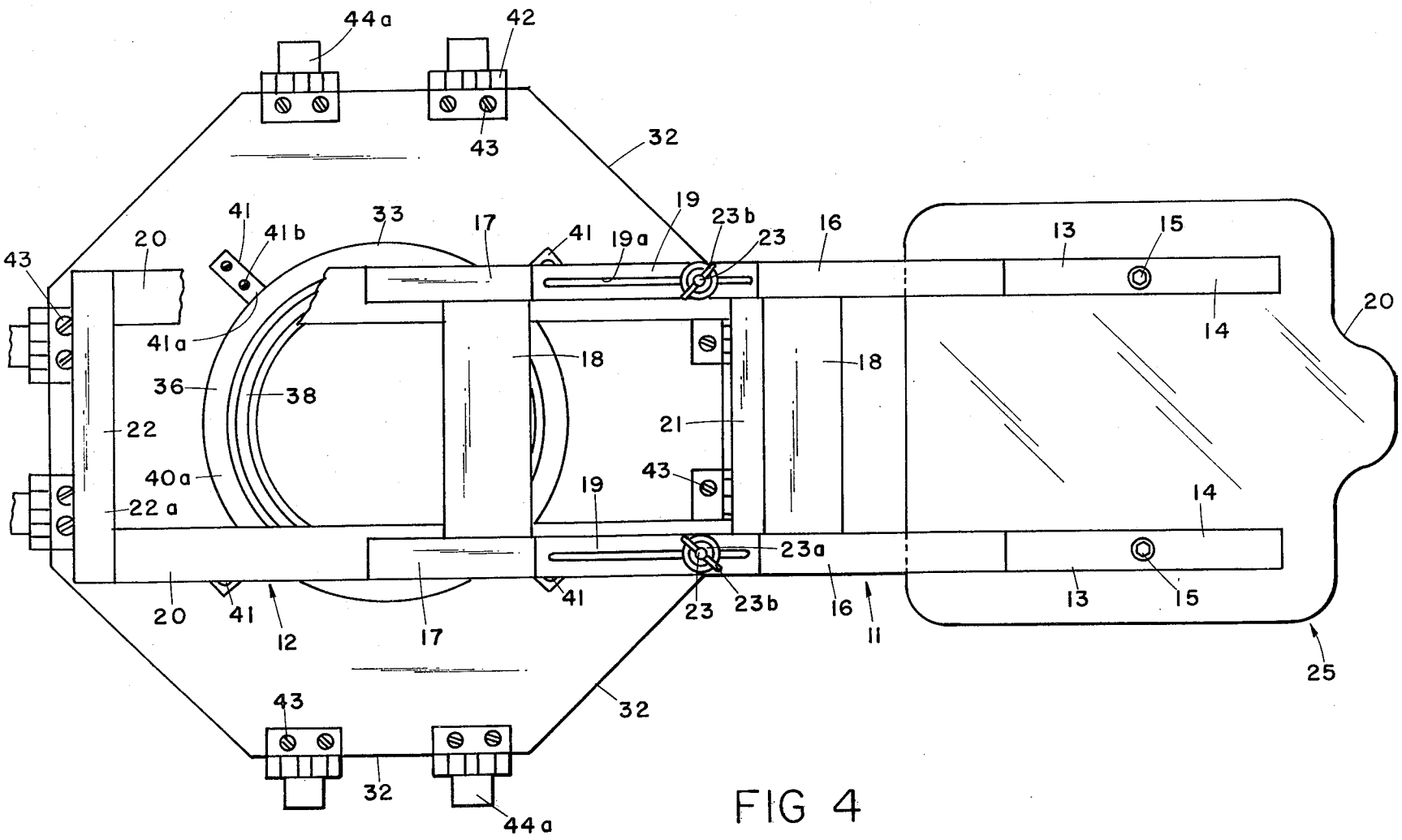
FIG. 4 is a bottom plan view of the second embodiment of the screen printer shown in FIGS. 2 and 3, with a portion thereof broken away.

The printing head 30 is rotatably connected with the rear frame section 12, thereby forming a printing head assembly 30. The rearward frame section 12 also includes a pair of parallel side rails 20 (FIG. 4) which are spaced apart a distance substantially commensurate with the forward frame section side rails 13. The rear side rails 20 are interconnected by a front cross brace 21 and a rear cross brace 22, which includes a lower surface **22*a* thereof which is disposed along a plane coincident with the forward frame feet 16 and 17, and is adapted for engaging a table top therewith to support the screen printer. As best illustrated in FIGS. 2 and 4, a fastener 23 is fixedly mounted in the forward portion of each of side rails 20, depends therefrom, and extends through a corresponding one of the slots 19*a* to a point disposed slightly therebelow. In the illustrated structure, the fasteners 23 are in the nature of carriage bolts. A washer 23*a* is positioned over the free end of the fastener 23, and a wing nut 23*b* is screwed onto the bolt and draws washer 22 securely against the lower surface of the frame rail medial portion 19 adjacent each side of the slot 19*a*, thereby providing means for slideably interconnecting the forward and rearward frame sections 11 and 12, and retaining the same in a preselected position. When the wing nuts 23 are loosened, the forward and rearward frame sections 11 and 12 may be longitudinally translated with respect to each other to adjust the distance between the printing head 30 and platen 25**, so as to position the pattern onto the article at the desired location.

The printing platen 25 (FIG. 1) includes a smooth, planar upper surface 26 which is adapted to receive thereon an article to be printed (not shown). The illustrated printing platen 25 is particularly adapted for printing T-shirts or jackets, and includes a substantially rectangular shape, with a protuberance 27 extending from the forward end edge thereof which is shaped to extend through the neck portion of the T-shirt. The printing platen 25 is preferably constructed of a durable, transparent material, such as a clear synthetic resin, to improve visual registry of the various printing screen designs. The platen 25 is preferably secured to frame 10 by threaded fasteners 15, such that the platen can be easily removed and replaced with another platen for printing articles of different sizes and shapes. The platen 25 also may include a retaining mechanism (not shown) to securely hold the T-shirt in place while the same is being printed.

Figure 5:
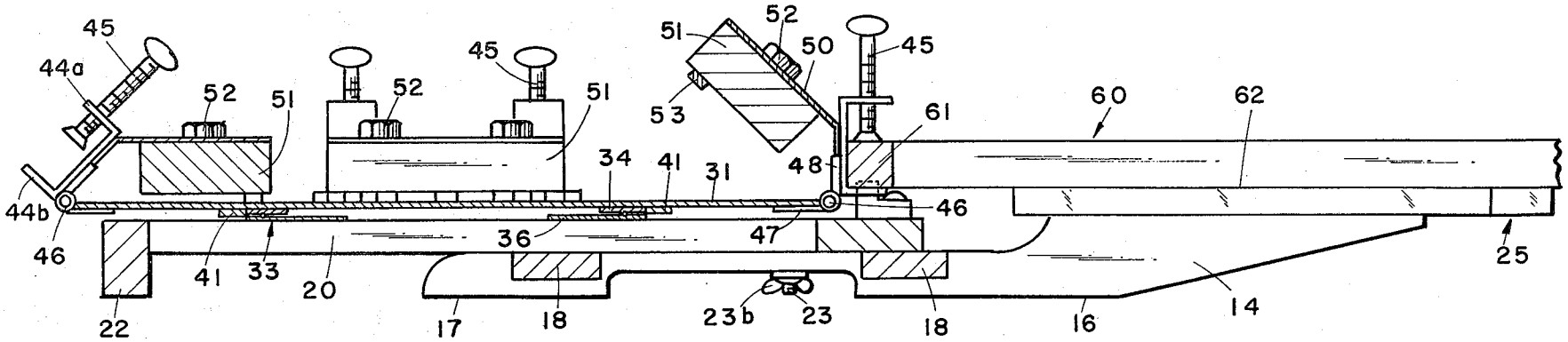
FIG. 5 is a vertical cross-sectional view of the screen printer taken along the line V—V, FIG. 3.
Figure 6:
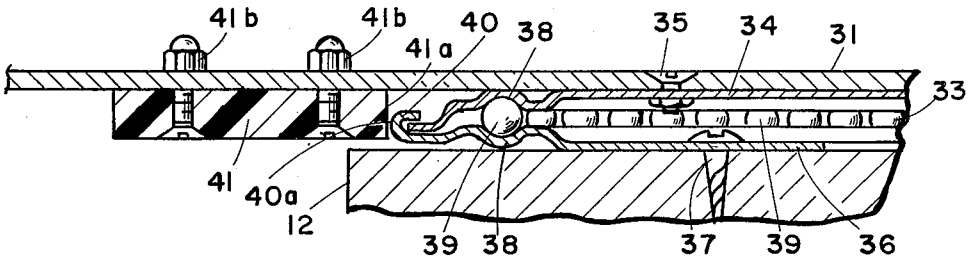
FIG. 6 is an enlarged, fragmentary vertical cross-sectional view of a thrust bearing portion of the screen printer.

In the printing head assembly 30', the printing head 30 (FIG. 3) is rotatably connected with the rear frame section 12, whereby selective rotation of printed head 30 sequentially positions printing screens 60 over platen 25. In the example shown in FIGS. 2–5, printing head 30 comprises a base plate 31 having an octagonal shape with side edges 32. The printing head shown in FIG. 1 has a hexagon shape, and carries only three screens 61, but is otherwise identical to the structure illustrated in FIGS. 2–6, and therefore bears the same reference numerals for similar parts. The base plate 31 is rotatably connected to a medial portion of the rear frame section 12 by a conventional, annularly-shaped thrust bearing 33 (FIGS. 5 and 6), in the nature of those used with a lazy susan arrangement. The thrust bearing 33 includes an upper ring 34 attached to the lower surface of the base plate 31 by fasteners 35 (FIG. 6), and a lower ring 36 attached to the upper surface of the rearward frame section 12 by fasteners 37. The upper and lower rings 34 and 36 each include an arcuately shaped, concave channel or track 38 therein extending annularly adjacent the outer edge of the rings, between which a plurality of spherically shaped ball bearings 39 are disposed to form an antifriction bearing. The outer edge 40 of the lower bearing ring 36 is formed in an U-shape about the peripherial edge of the upper ring 34 to capture the same therebetween with a small gap on each side thereof to avoid interference, thereby forming a bearing assembly to facilitate installation of the same in the screen printer. The exterior surface **40*a* of the U-shaped edge portion is round and smooth. At least three stops 41 are connected with and depend from the lower surface of the base plate 31 on opposite sides of rings 34 and 36 at a position adjacent to the outermost surface 40*a* of the U-shaped outer edge 40. The stops 41 include flat end edges 41*a* which are adapted for abutment with outer edge 40*a* so as to insure concentric alignment of bearing rings 34 and 36, and thereby achieve accurate registry of the printing screens 60. The stops 41 are preferably constructed from a durable, self lubricating material, such as nylon, and are attached to base plate 31 by a pair of fasteners 41*b* with end edge 41*a* oriented substantially perpendicular, with a line extending from the printing head's axis of rotation and along the longitudinal center line of the stop 41. The use of stops 41 makes it possible to use an inexpensive thrust bearing assembly 33, rather than an expensive precision unit. In the illustrated structure, four stops 41 are arranged about thrust bearing 33** in approximately 90 degree intervals.

Figure 3:
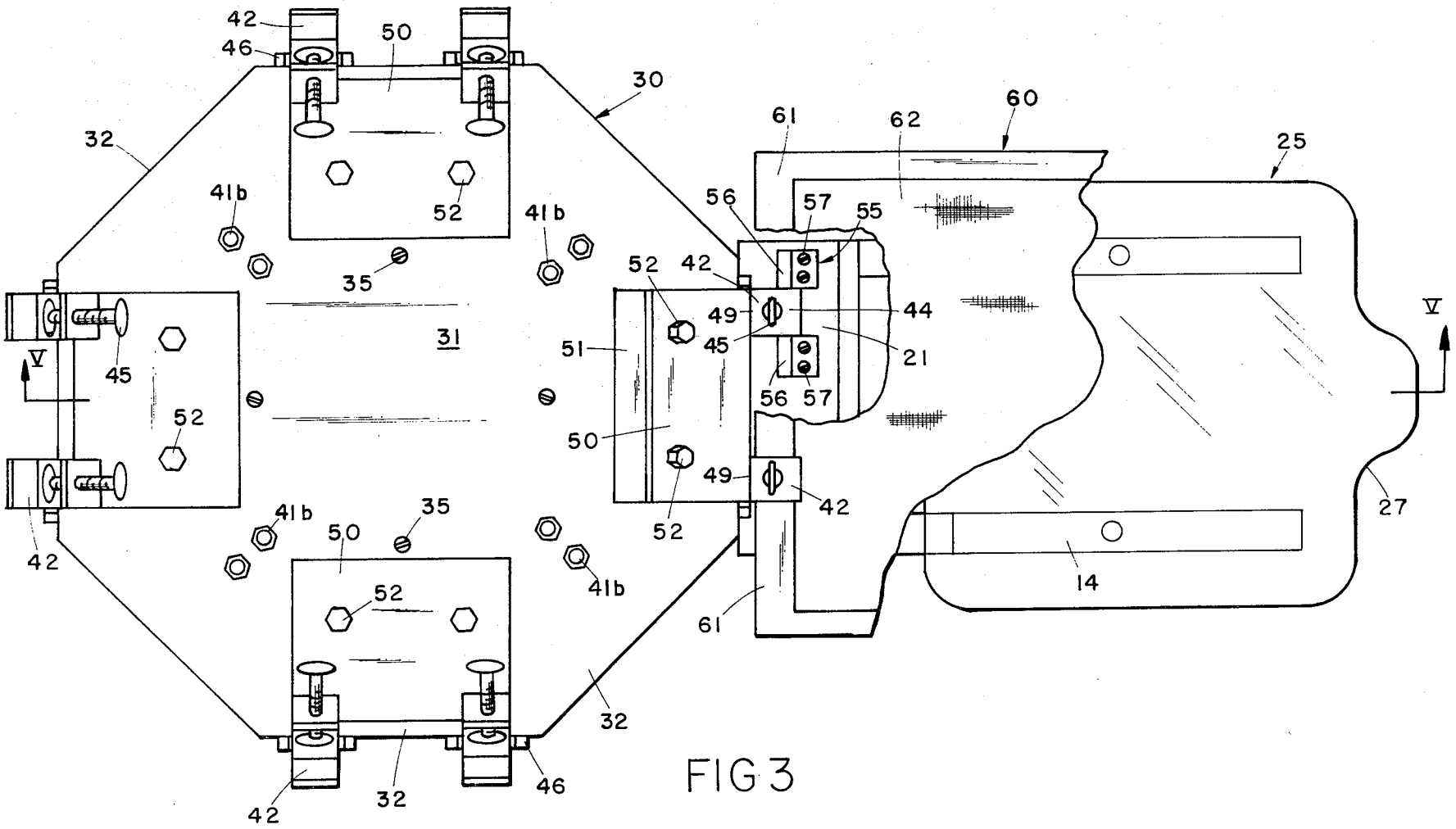
FIG. 3 is a top plan view of the second embodiment of the screen printer shown in FIG. 2, with portions thereof broken away to reveal internal construction.

The screens 60 with which the printer 1 is adapted to be used are conventional screens of virtually any size and shape compatible with a platen capable of being connected with the machine. The screens illustrated in FIGS. 1 and 3 are noted by the reference numeral 60, and include a wooden border or frame 61 with a partially imperforate screen 62 mounted tautly therein. The frame 61 is preferably large enough to extend outwardly of the sides and ends of platen 25, such that when the screen 60 is in the printing position, as shown in FIG. 1, only the screen touches the article on the platen 25. Each of the screens 60 includes a perforate portion in the shape of a design 63 through which the printing dye or ink may be squeezed, as described in greater detail hereinafter.

The printing screens 60 (FIG. 3) are detachably connected with the printing head base plate 31 by hinged clamps 42, which are attached to selected side edges 32 of base plate 31 by fasteners 43 (FIG. 4). As best illustrated in FIG. 2, the hinged clamps 42 comprise a C-shaped clamp member 44 with the open face thereof oriented outwardly. The clamp member 44 includes upper and lower jaws 44*a* and 44*b*, with a threaded fastener 45 mounted in the upper jaw 44*a*. A hinge 46 pivotally connects clamp 44 with base plate 31, and has one face 47 thereof attached to the lower surface of base plate 31, and the other face 48 attached to the rear surface of the clamp's back channel member 49. The axis of rotation of the hinge preferably lies in a plane parallel with the upper and lower surfaces of base plate 31 and intersects a medial portion thereof. The free ends of the clamp fasteners 45 include an enlarged washer 45*a* which is adapted to abut the screen frame 61, and may be adjusted in infinitesimally small increments to retain a wide variety of differently sized screens 60.

The hinged clamps 42 are positioned on four opposing side edges of base plate 31, and as best shown in FIGS. 3 and 4, are arranged in pairs on opposite ends of each of the selected side edges 32. Each pair of hinged clamps is interconnected by a support member 50 (FIG. 3) which extends along the rear face of the clamp's back channel member 49, and is connected therewith by fasteners. The support member 50 includes a counterweight 51 attached thereto by a fastener 52, which normally maintains the hinged clamps 42 and screens 60 in the storage position, wherein printing screens 60 are pivoted upwardly from the plane of platen 25. A resilient stop 53 (FIG. 5) is connected with the lower surface of the counterweight 51 and serves to dampen abutment between counterweight 51 and base plate 31 as the hinged clamp assembly is pivoted back into the storage position. In the illustrated structure, support member 50 is angled in a manner which retains hinged clamps 42 and printing screen 60 at an angle in the nature of 45 degrees when the assembly is in the storage position. The angle of support member 50 is also coordinated with the weight of counterweight 51, such that the screens 60 will remain static or stationary in the printing position after they have been placed there by the user. As the screens are lifted from the printing position, the center of gravity of the screen 60 and counterweight 51 respectively converges and diverges with respect to the hinge point. In this manner, after the screen 60 has been rotated upwardly to a preselected angle, in the nature of 20–40 degrees, depending upon the weight and shape of the screen, the counterweight 51 will balance and then overcome the torque resulting from the weight of the screen, and automatically return the screen to the storage position.

As best illustrated in FIG. 3, the screen printer includes a stop 55 connected with the frame 10 which selectively engages the hinged clamps 42 in the printing position, and positively positions the screens 60 in a predetermined angular relationship with printing platen 25, thereby providing registry between the designs in the various printing screens. The illustrated stop 55 comprises a pair of blocks 56 which are disposed on the upper surface of the rearward frame cross brace 21 at a position spaced slightly radially outwardly from the marginal edge of base plate 31. The blocks 56 are spaced apart a distance substantially commensurate with the width of the lower jaw 44*b* of the clamp member 44, such that the same may be slideably received therebetween. The blocks 56 include an upwardly protruding rear portion which is positioned at a preselected elevation, whereby in the storage position, the blocks are spaced apart from the clamp lower jaw 44*b* to permit free rotation of the printing head, and in the printing position, the blocks 56 project up into the rotational path of the clamp lower jaw 44*a* to restrict rotation of the printing head. When one of the printing screens 60 is pivoted downwardly toward the printing position, in order for screen 62 to abut the article disposed on platen 25, the printing head must be rotated in a manner to position the associated hinged clamp 42 between the stop blocks 56. If the hinged clamp is not so positioned, the lower jaw 44*b* of the clamp abuts the upper surface of the block 56 and prevents the printing screen from being abuttingly engaged with the article. When the hinged clamp 42 is properly positioned between stop blocks 56, printing screen 62 may be pivoted downwardly into an abutting relationship with the article, thereby simultaneously fixing the angular position of the printing head and screen with respect to platen 25 to achieve accurate registry between the designs on the various printing screens.

Figure 8:
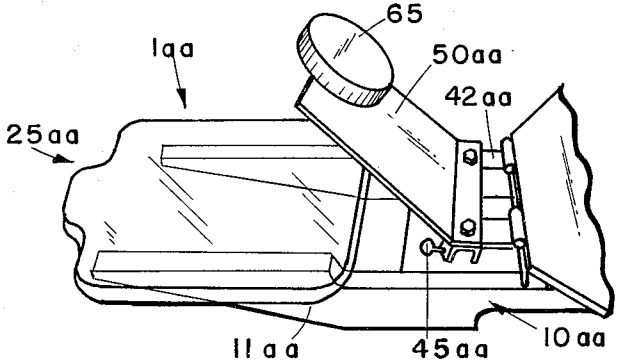
FIG. 8 is a perspective view of the third embodiment of the screen printer, with the counterweight assembly pivoted forwardly for illustrative purposes, and showing the counterweight in an extended position.
Figure 9:
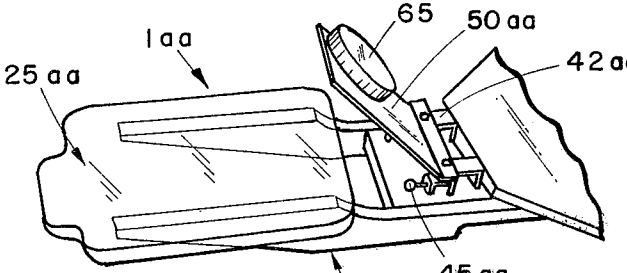
FIG. 9 is a perspective view of the screen printer shown in FIG. 8, with the counterweight shown in a retracted position.
Figure 7:
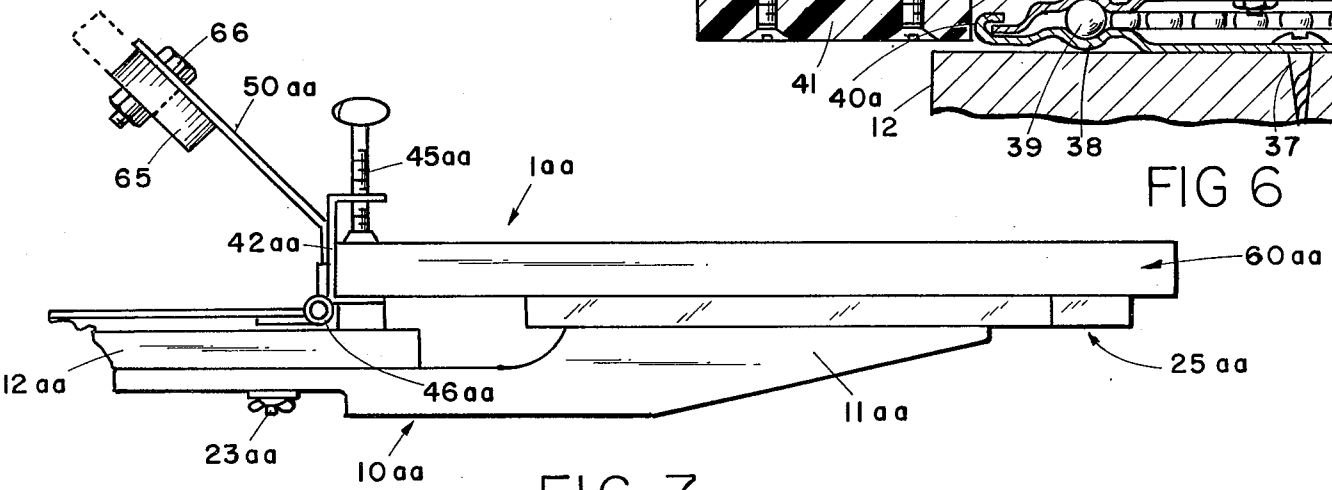
FIG. 7 is a side elevational view of a one-screen, one-color embodiment of the screen printer, particularly showing an eccentrically mounted counterweight assembly.

The reference numeral 1*aa* generally designates another embodiment of the present invention, as illustrated in FIGS. 7–9, and includes a variable counterweight arrangement to facilitate balancing variously sized printing screens. Since the screen printer 1*aa* is otherwise substantially similar to the previously described device 1, similar parts appearing in FIGS. 1–6 and 7–9 respectively are represented by the same, corresponding reference numeral, except for the suffix "aa" in the numerals of the latter. The printing screen 1*aa* includes a circularly shaped counterweight 65 which is rotatably connected with the support plate 50*aa* by a fastener 66 which extends through an axis eccentric to that of counterweight 65, whereby selective rotation of the counterweight varies the biasing force applied to the printing screen 60*aa*. If a very large and/or heavy printing screen 60*aa* is to be connected with the hinged clamps 42*aa*, the user simply loosens the fastener 66 slightly and rotates the counterweight 65 outwardly, as illustrated in FIG. 8, thereby moving the counterweight's center of gravity away from the pivot point of the hinged clamps. Conversely, if a relatively light printing screen is to be connected in the hinged clamps 42*aa*, the user simply rotates the counterweight 65 in a manner which moves its center of gravity inwardly toward the hinge pivot point. The eccentric mounting of counterweight 65 provides an easy means for balancing a wide variety of differently sized printing screens. The counterweight 61 is preferably adjusted in a manner whereby the screen will remain static or stationary in the printing position. This adjustment may be accomplished by manually pivoting each of the screens 60 sequentially into the printing position, and rotating the counterweight 51 until each screen is perfectly balanced on the platen 25. After the weight has been properly adjusted, fastener 66 is then retightened so as to secure counterweight 65 in place.

In use, a set of printing screens are selected in accordance with a specific pattern to be printed onto the article. The screens are typically designed in sets, with each set including that number of screens corresponding to the number of different colors which the complete pattern requires. It is to be understood however, that the present invention relates to the printing of any type of pattern, particularly bifurcated patterns with either multiple colors and/or one color and multiple parts. In the example illustrated FIG. 1, three printing screens 60 are provided, and the screen printer 1 includes three pairs of hinged clamps 42 to receive the printing screens therein. The illustrated printing screen set is designed to print three interlocking rings of different colors, with a three-color border around the ring design. Hence, each of the screens 60 has a different, mating design 63 therein, arranged to print a birfucated pattern which includes a single ring 63 and a rectangular boundary 64. The screens 60 are then adjusted by moving the screens in the hinged clamps 42, until such time as the three screens are in perfect registration, both as to radial position and angular position. The clamp fasteners 45 are then tightened snugly against the printing screen frames 61, so as to retain the printing screens in their proper place. The operator then places a different colored dye or ink on the inside surface of each printing screen 60, and the article to be printed is placed over platen 25.

The printing process is then commenced by rotating one of the printing screens 60 to a position above and in alignment with platen 25, and then manually pivoting the screen downwardly toward the printing position, while making sure that the associated hinged clamp 42 is received between the two stop blocks 56. The printing screen 60 is then urged firmly and abuttingly against the article, and a roller or squeegee is used to transfer the dye or ink through the printing screen 60 to print onto the article. The printing screen is then carefully permitted to pivot upwardly under the influence of counterweight 51 and the printing head 30 is then rotated to bring the next printing screen 60 over platen 25, and the above described sequense of steps is then repeated to print each of the designs onto the article, so as to achieve the completed pattern.

The embodiment of the invention 1*aa* illustrated in FIGS. 7–9 further includes the set-up step of balancing the eccentric counterweight 65 by loosening the fastener 66 and rotating the counterweight to a position wherein the hinged clamps 42*aa* and the printing screen 60*aa* connected therein are substantially balanced, yet maintains the assembly in a normal, upwardly inclined storage position. The fastener 66 is then retightened to retain counterweight 65 in place.

The user may wish to adjust the longitudinal positioning of the pattern on the shirt, so as to properly locate the pattern on both large and small size T-shirts. To accomplish this positioning, the user simply loosens both of the wing nuts 23, and slidingly translates the printing head assembly 30' with respect to the forward frame section 11. The upper frame rails 20 slide on top of the lower frame rails 13 for smooth adjustment. Once the proper positioning has been achieved, the user simply tightens wing nuts 23 to maintain the preselected location. Proper registry between the three screens in not lost in the process.

After the first selected design has been printed on a sufficient number of articles to satisfy the user's demand, the printing screen set may be replaced with another set, to print a second design. If the first selected set is not to be used for some period of time, the user typically will remove each of the printing screens 60 from the hinged clamps 42, by loosening fasteners 47 and translating the screens out from between the clamp jaws 44*a* and 44*b*. A second set of printing screens may then be inserted into hinged clamps 42 and the same must then be registered in the above described manner. If the user wishes to reuse the first pattern at some later date, he may replace the design without disturbing the registry between the various printing screens 60 by simply loosening wing nuts 23, and bodily removing the printing head assembly 30' (with screens 60 mounted therein) from forward frame section 11. A second printing head assembly 30' is then fastened to forward frame section 11 to print a different pattern. In this manner, the printing design may be easily changed without disturing the registry between the various printing screens. The longitudinal placement of the pattern on the T-shirt may also be adjusted by slidingly positioning the printing head assembly 30 and the forward frame section 11, without effecting the registry between the screens 60. Further, the stop blocks 56 provide accurate angular registry of printing screens 60, and the thrust bearing stops 41 provide accurate radial registry of the printing screens 60 with a relatively uncomplicated, inexpensive design. The eccentric counterweights 65 permit the screen printer to be easily used with a wide variety of variously sized printing screens 60.

In the foregoing description, it will be readily appreciated by those skilled in the art that many modifications may be made to the invention without departing from the concepts disclosed herein. Such modifications are to be considered as included in the following claims unless these claims by their language expressly state otherwise.

The embodiments of the invention in which an exclusive property or privilege is claimed are defined as follows:

1. A screen printing machine, comprising:

a frame;

a printing platen fixedly connected with said frame and adapted to receive thereon an article to be printed;

a printing head having at least two pairs of C-shaped clamps; each pair of clamps being hingedly attached to a different side of said printing head for connecting therewith at least two printing screens having different, mating designs therein arranged to print a bifurcated pattern on said article, and each of said screens having an end segment; each of said clamps having an open face which is oriented outwardly and adapted to receive and retain the end segment of said printing screens therein; means for rotatably connecting said printing head with said frame, whereby selective rotation of said printing head sequentially positions said screens over said platen; and means for translating each of said printing screens between a printing position wherein said screens are sequentially aligned with said printing platen and abuttingly overlie the article thereon, and a storage position wherein said printing screens are spaced apart from said printing platen;

means for slideably connecting said printing head with said frame for varying the distance between said printing head and said printing platen and selectively locating the position of said pattern on said article without disturbing the registry between the designs on said printing screens; and a registry stop connected with said frame and having first and second portions between which at least one of said clamps are received and retained in said printing position for positively positioning said screens in a predetermined angular relationship with said printing platen.

2. A screen printing machine as set forth in claim 1, wherein:

said printing head connecting means detachably mounts said printing head on said frame, whereby said printing head can be bodily removed from said frame and replaced with an alternate printing head without disturbing the registry between the designs on said printing screens.

3. A screen printing machine as set forth in claim 1 or 2, wherein:

said connecting means includes a thrust bearing rotatably connecting said printing head with said frame, whereby rotation of said printing head sequentially positions said screens over said printing platen; said bearing including:

first and second circular plates with peripherial edges; said plates being disposed in a coaxial relationship overlying each other, and having antifriction bearing means therebetween to facilitate angular displacement of said plates; and at least three stops connected with one of said printing head and said frame, and being disposed adjacent to the peripheral edge of one of said plates at opposite sides thereof; said stops each including a portion thereof disposed concentric with the axis of rotation of said printing head, and adapted for abutment with said one peripherial plate edge to insure concentric alignment of said plates.

4. A screen printing machine as set forth in claim 3, wherein said clamps include:

counterweights connected with said hinged clamps and normally maintaining said printing screens in the storage position; and means for rotatably connecting said counterweights with said hinged clamps about an eccentric axis, whereby selective rotation of said counterweights varies the biasing force applied to said hinged clamps to facilitate balancing variously sized printing screens.

5. A screen printing machine as set forth in claim 1 or 2, wherein said clamps include:

counterweights connected with said hinged clamps and normally maintaining said printing screens in the storage position; and means for rotatably connecting said counterweights with said hinged clamps about an eccentric axis, whereby selective rotation of said counterweights varies the biasing force applied to said hinged clamps to facilitate balancing variously sized printing screens.

6. A screen printing machine comprising:

a frame;

a printing platen connected with said frame and adapted to receive thereon an article to be printed;

a printing head, including hinged clamps detachably connecting said printing head with at least two printing screens having different, mating designs therein arranged to print a bifurcated pattern on said article; said hinged clamps permitting said printing screens to be pivoted through a substantially vertical plane between a printing position wherein said screens are sequentially aligned with said printing platen and abuttingly overlie the article thereon, and a storage position wherein said printing screens are spaced apart from said printing platen;

a registry stop connected with said frame and having first and second portions between which said clamps are received and retained in said printing position for positively positioning said screens in a predetermined angular relationship with said printing platen;

means slideably connecting said printing head with said frame for varying the distance between said printing head and said printing platen and selectively locating the position of said pattern on said article without disturbing the registry between the designs in said printing screens;

means detachably connecting said printing head with said frame, whereby said printing head can be bodily removed from said frame and replaced with an alternate printing head without disturbing the registry between the designs in said printing screens;

a thrust bearing rotatably connecting said printing head with said frame, whereby rotation of said printing head sequentially positions said screens over said printing platen; said bearing including:

first and second circular plates disposed in a coaxial relationship overlying each other, and having antifriction bearing means therebetween to facilitate angular displacement betweeen said plates; and at least three stops connected with one of said printing head and said frame, and being disposed adjacent to the peripheral edge of one of said plates at opposite sides thereof; said stops each including a portion thereof disposed concentric with the axis of rotation of said printing head, and adapted for abutment with said one peripheral plate edge to insure concentric alignment of said plates.

7. A screen printing machine as set forth in claim 6, including:

counterweights connected with said hinged clamps and normally maintaining the screens in the storage position, and including means for rotatably connecting said counterweights with said hinged clamps about an eccentric axis, whereby selective rotation of said counterweights varies the biasing force applied to the hinged clamps to facilitate balancing variously sized printing screens.

8. A screen printing machine comprising:

a frame;

a printing platen connected with said frame and adapted to receive thereon an article to be printed;

a printing head including first means for connecting therewith at least two printing screens having different, mating designs therein arranged to print a bifurcated pattern on said article; said first connecting means having means for translating each of said printing screens between a printing position wherein said screens are sequentially aligned with said printing platen and abuttingly overlie the article thereon, and a storage position wherein said printing screens are spaced apart from said printing platen;

second means rotatably connecting said printing head with said frame, whereby rotation of said printing head sequentially positions said screens over said platen;

a registry stop having one portion thereof connected with one of said frame and said printing head, and a second, mating portion thereof connected with the other of same frame and said printing head, and being shifted between locked and unlocked positions by translation of either of said frames between said printing and storage positions respectively; said second stop portion being received in a captured by said first stop portion in the printing position for positively positioning said screens in a predetermined angular relationship with said printing platen and providing registry between the designs in said printing screen;

said screen connecting means comprising hinged clamps having a C-shaped jaw between which said screens are detachably retained; and said registry stop first portion comprising a pair of blocks spaced apart on said frame a distance substantially commensurate with the width of a lower portion of each of said hinged clamps; said hinged clamp lower portion comprising said registry stop second portion, and being disposed above said blocks in the storage position to permit free rotation of said printing head, and disposed between said blocks in the printing position.

9. A screen printing machine as set forth in claim 8, wherein:

said blocks have an upper surface spaced above said frame a distance which prevents said screens from converging into contact with said platen unless said printing head is in one of the predetermined angular positions for printing.

10. In a screen printing machine including a frame, a printing platen connected with said frame and adapted to receive thereon an article to be printed, and a printing head adapted for mounting a printing screen therein, the improvement comprising:

a thrust bearing rotatably connecting said printing head with said frame, whereby rotation of said printing head positions said printing screen over said printing platen; said bearing including:

first and second circular plates disposed in a coaxial relationship overlying each other, and including antifriction bearing means therebetween to facilitate angular displacement of said plates; and at least three stops connected with one of said printing head and said frame and being disposed adjacent to the peripheral edge of one of said plates at opposite sides thereof; said stops each including a portion thereof disposed concentric with the axis of rotation of said printing head and being adapted for abutment with said one peripheral plate edge so as to insure concentric alignment of said plates.

11. A screen printing machine as set forth in claim 10, wherein:

said printing head is adapted to mount therein at least two printing screens having different mating designs therein arranged to print a bifurcated pattern on said article, whereby rotation of said printing head on said thrust bearing sequentially positions said screens over said platen.

12. A screen printing machine as set forth in claim 11, wherein:

said antifriction bearing means comprises a plurality of ball bearings disposed between said plates and retained in a race formed therein.

13. A screen printing machine as set forth in claim 11, wherein:

said stops are connected with said printing head, depend from a lower surface thereof, and abut the peripheral edge of said second plate which is connected with said frame.

* * * * *

UNITED STATES PATENT AND TRADEMARK OFFICE

CERTIFICATE OF CORRECTION

PATENT NO. : 4,315,461

DATED : February 16, 1982

INVENTOR(S) : Charles W. Harpold

It is certified that error appears in the above—identified patent and that said Letters Patent is hereby corrected as shown below:

Column 1, line 29:

"accomodate" should be --accommodate--

Column 7, line 45:

"sequense" should be --sequence--

Column 7, line 67:

"screens in" should be --screens is--

Column 8, lines 20 & 21:

"disturing" should be --disturbing--

Column 8, line 26:

"effecting" should be --affecting--

Column 9, Claim 3, line 29:

"peripherial" should be --peripheral--

UNITED STATES PATENT AND TRADEMARK OFFICE

CERTIFICATE OF CORRECTION

PATENT NO. : 4,315,461

DATED : February 16, 1982

INVENTOR(S) : Charles W. Harpold

It is certified that error appears in the above—identified patent and that said Letters Patent is hereby corrected as shown below:

Column 9, Claim 3, lines 40 & 41:

"peripherial" should be --peripheral--

Column 10, Claim 6, line 37:

"betweeen" should be --between--

Column 11, Claim 8, line 10:

"same" should be --said--

Column 11, Claim 8, line 14:

"a" should be --and--

Signed and Sealed this

*Eighth* Day of *June 1982*

[SEAL]

*Attest:*

*Attesting Officer*

GERALD J. MOSSINGHOFF

*Commissioner of Patents and Trademarks*